United States Patent [19]

Lawson

[11] 4,317,587

[45] Mar. 2, 1982

[54] SPLIT FASTENING RING AND ASSEMBLIES EMPLOYING SAME

[75] Inventor: John E. Lawson, London, England

[73] Assignee: Armco Inc., Middletown, Ohio

[21] Appl. No.: 120,045

[22] Filed: Feb. 11, 1980

[51] Int. Cl.[3] ..... F16L 21/06

[52] U.S. Cl. ..... 285/137 A; 285/321; 411/353; 411/517

[58] Field of Search ..... 151/38; 85/8.6, 8.8, 85/8.9; 403/261, 326, DIG. 7; 285/321, 137 A; 166/212, 208; 92/255, 256; 411/353, 517

[56] References Cited

U.S. PATENT DOCUMENTS

| | | | |
|---|---|---|---|
| 2,874,784 | 2/1959 | Bake | 166/212 |
| 3,011,557 | 12/1961 | Conrad | 166/212 |
| 3,455,578 | 7/1969 | Hanes | 285/321 X |
| 3,625,552 | 12/1971 | Mahoff | 151/38 UX |
| 3,807,285 | 4/1974 | Phillips | 92/225 |
| 4,102,239 | 7/1978 | Dallas | 151/38 |

*Primary Examiner*—William F. Pate, III

*Attorney, Agent, or Firm*—Roylance, Abrams, Berdo & Farley

[57] ABSTRACT

In devices, such as well tools, where two telescopically related members are telescopically related, the two members are connected together by a split ring in such fashion that loads are transferred from one member to the other via the split ring with the split ring accepting the load in compression.

11 Claims, 4 Drawing Figures

SPLIT FASTENING RING AND ASSEMBLIES EMPLOYING SAME

This invention relates to split ring fasteners and assemblies in which an element is secured thereby.

RELATED APPLICATIONS

Subject matter disclosed in this application is also disclosed and claimed in my copending applications Ser. Nos. 120,047, 120,851 and 120,046, all filed concurrently herewith.

BACKGROUND OF THE INVENTION

Split ring fasteners have long been used to secure telescopically related parts, i.e., parts having concentric circular surfaces disposed one within the other. Most frequently, the split ring is seated in a transverse annular groove and has an active face which lies in a plane at right angles to the central axis of the telescopically related surfaces and is exposed for axial engagement by, e.g., a transverse annular shoulder on the part to be secured. In such cases, the split ring may be thin, and may have a relaxed diameter different than that of its retaining groove, so that the ring is resiliently distorted in a sense forcing the ring into engagement in the groove. A common example is use of a split ring to secure a pulley on its shaft. With advance of the arts, cases have occurred in which the space available to accommodate such fastener rings is small, and prior-art workers have proposed to cant the ring so that, when installed, the active face or faces of the ring lie as frustoconical surfaces tapering toward the retaining groove. Thus, as seen in French Pat. No. 1,124,542, published Oct. 12, 1956, the split ring is a thin normally flat resilient ring which, when installed, is distorted into frustoconical form, with the spring force of the distorted ring urging one frustoconical face of the ring into engagement with an annular rounded edge on the part to be secured. Similarly, a relatively thin normally frustoconical split ring fastener is disclosed in U.S. Pat. No. 3,413,022, issued Nov. 26, 1968, to R. F. Waddell, one frustoconical face of the ring being in flush engagement with a frustoconical shoulder when the ring has been installed, the other frustoconical face of the ring engaging an annular corner presented by the retaining groove.

Such prior-art inventions have achieved success and acceptance for applications in which the split ring is required to transfer only relatively small forces. However, for applications where very large forces must be transferred from one part to another via the fastener ring, as in the case of well tools and the like, there has been a continuing need for improvement.

OBJECTS OF THE INVENTION

A general object of the invention is to devise a split ring fastener capable of transferring large forces.

Another object is to provide, in a device in which two telescopically related parts are connected by means including a split ring fastener, a split ring fastener via which all forces transferred through the ring from one part to the other are applied in directions essentially normal to the active surfaces of the split ring.

A further object is to provide, in such a device, a split ring fastener of such nature that all forces transferred via the ring include components tending to maintain the ring properly seated in its retaining groove.

Yet another object is to provide, in such a device, a split ring fastener such that forces transferred via the ring act on the ring largely in compression, shear forces and overturning moments being at least minimized.

SUMMARY OF THE INVENTION

In typical applications of the invention, two parts are connected by a split ring, each of the two parts having a cylindrical surface and the parts being telescopically related so that one of the cylindrical surfaces embraces the other. One of the parts is provided with a retaining groove for the split ring, the groove having a bottom wall, a first side wall which is frustoconical and slants away from the bottom wall, advantageously at approximately 45°, and a second side wall. The split ring is seated in the groove and has an annular surface which is at least immediately adjacent the bottom wall of the groove, a first active face which is frustoconical and disposed in flush engagement with the frustoconical first side wall of the groove, and a second active face which is frustoconical, parallel to the first active face and opposite thereto, the second active face extending beyond the confines of the groove. The second member has a transverse annular frustoconical shoulder which is parallel to and directed toward the second active face of the ring, this shoulder having a radial width not greater than the radial width of the frustoconical first side wall of the retaining groove, and the diameter of the shoulder being such that the shoulder engages the ring immediately adjacent the cylindrical surface of the first member. The first and second members are provided with coacting means, typically opposed shoulders, to hold the second member against substantial movement away from the ring. The ring is a machined metal piece and the thickness of the ring along lines normal to the two active faces is substantial, being equal to at least 50% of the radial width of the ring.

Upon occurrence of a force tending to move the two members relative to each other in a direction such that the second active face of the ring and the adjacent shoulder of the second member are urged together, the ring accepts the resulting load essentially in compression, with the load acting along lines of force which are normal to all of the four frustoconical surfaces, with all of the lines of force passing through the frustoconical first wall of the retaining groove.

IDENTIFICATION OF THE DRAWINGS

In order that the manner in which the foregoing and other objects are attained according to the invention can be understood in detail, particularly advantageous embodiments thereof will be described with reference to the accompanying drawings, which form part of the original disclosure of the application, and wherein.

DETAILED DESCRIPTION OF THE INVENTION

Figure 1:
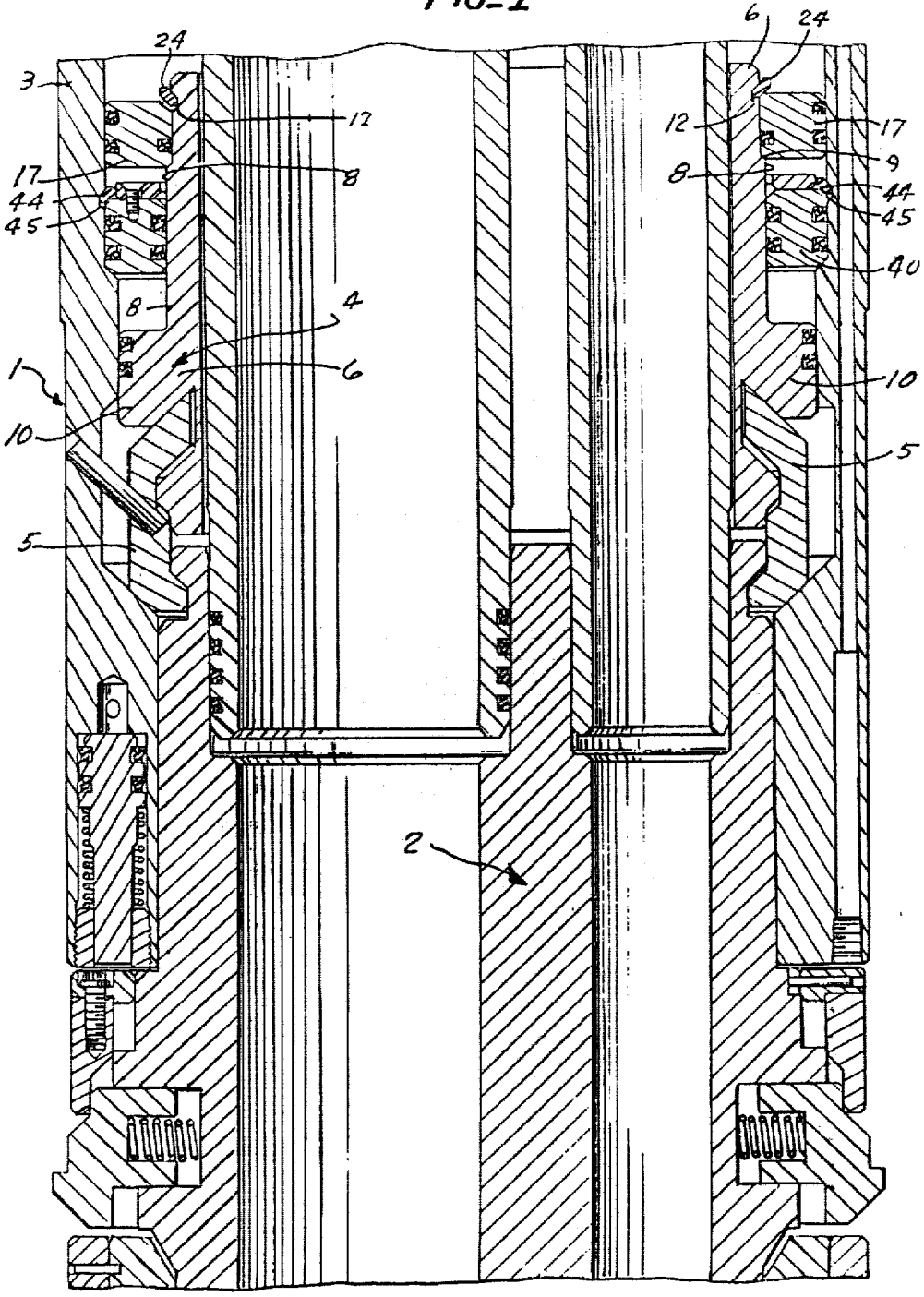
FIG. 1 is a vertical cross-sectional view of a portion of a multifunction well tool and attached tubing hanger.
Figure 2:
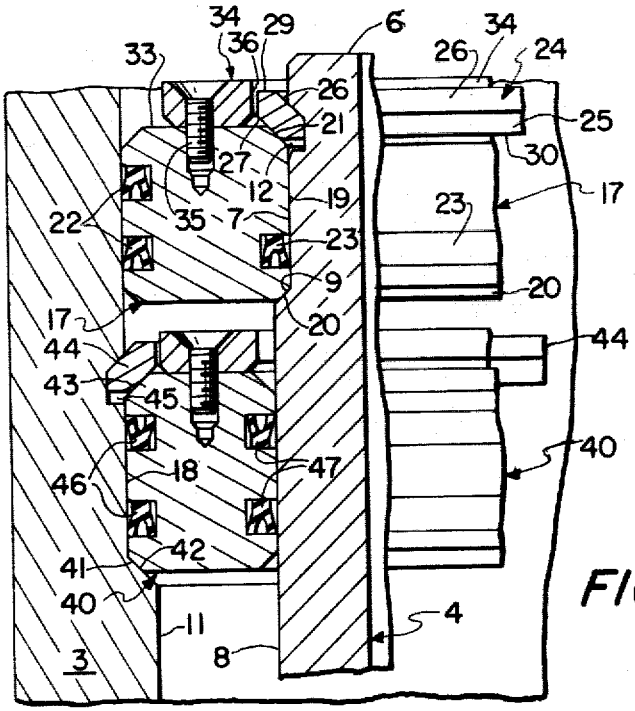
FIG. 2 is a fragmentary vertical sectional view, enlarged relative to FIG. 1 and with parts broken away for clarity, of a portion of the device of FIG. 1.

FIGS. 1 and 2 illustrate, as one typical application of the invention, a multifunction handling tool 1 employed to first rotationally orient, then land in an underwater wellhead or the like, a multiple string tubing hanger 2. Tool 1 has a tubular body 3 which embraces a tubular piston 4 employed to actuate a plurality of arcuate segments 5 by which tubing hanger 2 is attached to tool 1 in the manner described in my copending application Ser. No. 120,851. Tools of the type shown are employed to lower the combination of the tubing hanger and two or more strings of tubing into the well, with the operation being carried out, e.g., from a vessel or other operational base at the surface of the sea or other body of water. As is well known in the art of drilling and completing wells, operations such as the running in of tubing strings are carried out with the aid of guidance systems which extend from the vessel or other operational base down to, e.g., the site of a wellhead at or near the ocean floor. Units being lowered, such as the combination of tool 1, hanger 2 and the tubing strings (not shown) which depend from the hanger, are lowered by a handling string. Throughout the operation, the entire weight of the tubing strings is applied to the handling tool, in this case to handling tool 1, via segments 5 and piston 4. The weight of the tubing strings may be as large as 300,000 pounds. The direct load applied by the tubing strings is transferred via the lower portions of segments 5 to the lower portion of body 3 of tool 1. However, because of the magnitude of this direct load, piston 4 is subjected to very large axial forces, both during the time segments 5 are engaged to secure hanger 2 to tool 1 and as the piston is actuated to release the segments so that, after the hanger has been landed and tested, the handling tool can be recovered.

Piston 4 comprises a tubular body 6 having at its upper end a right cylindrical outer surface portion 7 and, therebelow, a right cylindrical outer surface portion 8 of slightly larger diameter than portion 7, portions 7 and 8 being joined by a transverse annular frustoconical shoulder 9 which tapers upwardly and inwardly at 45°. Portion 8 terminates at an annular outwardly projecting piston flange 10, the outer periphery of which slidably engages inner surface portion 11 of body 3.

Figure 4:
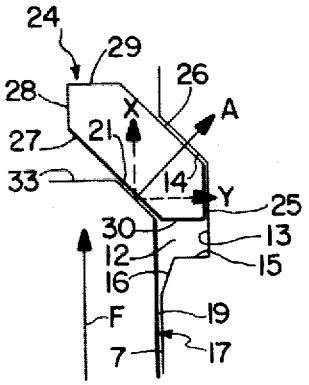
FIG. 4 is an enlarged semi-diagrammatic view of the fastener.

Near the top of body 6, outer surface portion 7 is interrupted by a transverse annular outwardly opening retaining groove 12 which, as best seen in FIG. 4, has a right cylindrical bottom wall 13, a first side wall 14 which is frustoconical and tapers downwardly and inwardly at approximately 45°, and a second side wall including an inner portion 15, which is flat and at right angles to the longitudinal axis of the piston, and an outer portion 16, which is frustoconical and tapers upwardly and inwardly at a relatively small angle.

An upper seal ring 17 effectively closes the annular space between piston 4 and inner right cylindrical surface portion 18 of tool body 3. Ring 17 has a right cylindrical inner surface 19 which closely embraces surface portion 7 of piston body 6. At its lower end, surface 19 terminates in a transverse annular frustoconical shoulder 20 which tapers upwardly and inwardly and is parallel to shoulder 9. At its upper end, surface 19 terminates in a transverse annular frustoconical shoulder 21 which tapers downwardly and inwardly and is parallel to and spaced from side wall 14 of groove 12. Ring 17 is grooved to accommodate outer sealing rings 22, which form fluid-tight seals between the outer surface of ring 17 and inner surface portion 18 of the tool body, and an inner sealing ring 23 which forms a fluid-tight seal between surfaces 7 and 19, the sealing rings 22, 23 being of elastomeric material and constructed and oriented to be energized by fluid pressure in the annular cavity below ring 17.

Figure 3:
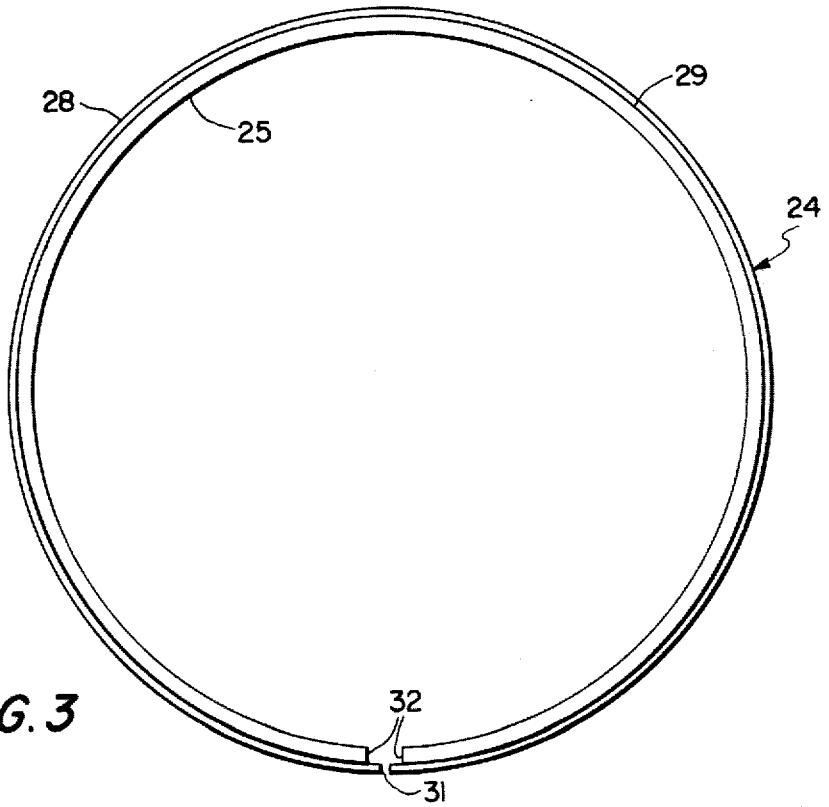
FIG. 3 is a top plan view of a split ring fastener employed in the device of FIG. 1.

Seated in groove 12 and retained thereby is a resilient metal split ring fastener 24. As best seen in FIGS. 3 and 4, split ring 24 has a right cylindrical inner surface 25, a first active face 26 which is frustoconical and tapers downwardly and inwardly at the same angle as does side wall 14 of groove 12, a second active face 27 which is parallel to and faces away from face 6, and a right cylindrical outer surface 28. The radial width of face 26 is at least as great as that of wall 14 of groove 12 and advantageously substantially greater. Face 26 extends inwardly to join inner face 25. In this embodiment, the radial distance between cylindrical surfaces 25 and 28 is substantially larger than the radial width of face 26, and a flat transverse annular surface 29 extends from outer surface 28 to the outer periphery of face 26. Active face 27 extends from outer surface 28 to join a second flat transverse annular surface 30 which constitutes the bottom surface of split ring 24 and has a radial width which is advantageously equal to or slightly less than the radial distance between surface 7 and bottom wall 13 of groove 12. The configuration just recited represents the configuration of split ring 24 when the ring is relaxed, i.e., in its resiliently undistorted condition. Ring 24 can be made from a ring of rectangular radial cross section by removing two corner portions of the rectangle. The thickness of the finished ring along lines normal to active faces 26, 27 is substantial, being equal to at least 50% of the radial distance between surfaces 25 and 28. The ring is completed by providing a radial saw-cut at 31, FIG. 3, and by providing inwardly opening right-angle notches 32 to accommodate a tool for expanding the ring.

With piston 4 in place within body 3, ring 17 is inserted into the annular space between surfaces 7 and 18 until shoulder 20 of the ring engages shoulder 9 of piston body 6. With the ring thus situated, shoulder 21 is spaced from side wall 14 of groove 12 by a distance slightly larger than the thickness of ring 24 along a line normal to active faces 26, 27. Ring 24 is installed by first inserting an expanding tool into notches 32 and expanding the ring until the diameter of inner surface 25 is substantially larger than the diameter of surface 7, then placing the expanded ring over the upper end of piston body 6 and lowering the ring, still expanded, until surface 30 engages the upper end face 33 of seal ring 17, and then manipulating the expanding tool to allow ring 24 to contract gradually. With ring 17 seated on shoulder 9, the active shoulder 21 of ring 17 is spaced from side wall 14 of groove 12 by an axial distance slightly greater than the width of inner surface 25 of split ring 24. Accordingly, as ring 24 is allowed to contract, while surface 30 rests on the upper end face 33 of ring 17, the inner periphery of ring 24 enters groove 12 and the active face 26 of ring 24 comes into sliding engagement with side wall 14 of the retaining groove. Then, as ring 24 is allowed to continue contracting and surface 30 passes the upper edge of shoulder 21, the expanding tool is lowered so that, as ring 24 contracts, it travels into groove 12 in a direction generally parallel to side wall 14. As ring 24 becomes completely relaxed, or nears complete relaxation, inner surface 25 advantageously comes into flush engagement with bottom wall 13 of the retaining groove and active face 26 of the ring lies in flush engagement with side wall 14 of the groove.

At this point, with no axial force applied either to piston body 6 or seal ring 17, so that shoulder 20 is seated on shoulder 9, shoulder 21 is spaced slightly below active face 27 of ring 24. In this connection, it will be observed that split ring fastener 24 serves only to secure ring 17 and piston body 6 against relative axial movement tending to increase the spacing between flange 10 and seal ring 17. Shoulders 9 and 20 coact to limit relative movement between body 6 and seal ring 17 in the opposite sense. After split ring 24 has been installed, a retaining ring 34 is fixed to the upper end of seal ring 17, as by screws 35. Ring 34 presents a right cylindrical inner surface 36 which is concentric with and spaced outwardly from split ring 24. Thus, ring 34 serves to assure that, under extreme conditions of shock or distorting force, split ring 24 cannot escape from groove 12.

Outer surface 8 of piston body 6 is slidably embraced by a second seal ring 40. At its lower end, ring 40 has a downwardly and inwardly tapering frustoconical shoulder 41 opposed to a similar shoulder 42 which joins surface portions 11, 18 of tool body 3. At its upper end, ring 40 has a downwardly and outwardly tapering shoulder 43 to coact with split ring fastener 44 engaged in retaining groove 45 in tool body 3. Split ring 44 is resiliently biased outwardly into its retaining groove, and the four coacting frustoconical faces presented by the groove, the split ring and seal ring therefore taper upwardly and inwardly. Split ring 44 is thus complementary to split ring 24 and serves to secure ring 40 to tool body 3 in the same manner as split ring 24 secures seal ring 17 to piston body 6. Ring 40 is grooved to accommodate sealing rings 46, which seal between the outer surface of ring 40 and inner surface portion 18 of tool body 3, and sealing ring 47, which seal between the inner surface of ring 40 and outer surface 8 of piston body 6.

When it is desired to disconnect handling tool 1 from tubing hanger 2, hydraulic fluid under pressure is supplied to the annular space defined by tool body 3, piston body 6 and rings 17, 40. Ring 40 being seated on shoulder 42 and therefore held against downward movement, the pressure applied by the hydraulic fluid forces ring 17 upwardly, causing split ring 24 to be clamped in compression between shoulder 21 of ring 17 and side wall 14 of groove 12, with ring 24 then transferring the forces to piston body 6. An upward strain is thus applied to coupling segments 5. The force thus applied to piston body 6 is a large force, adequate to cause segments 5 to be cammed outwardly until the segments no longer engage hanger 2.

While the force F generated by supply of pressure fluid to the space between rings 17 and 40 acts axially on ring 17, the force is applied to split ring 24 as the vector indicated at A, FIG. 4, the vector being at right angles to the active faces of ring 24 and therefore at right angles to side wall 14 of groove 12. While the force represented by vector A can be considered as having an axial component X and a radial component Y, it will be noted that a radial component in the direction Y acts only to seat ring 24 more securely in its retaining groove, and that the axial component is concentrated on the smaller area represented by shoulder 21 and, being spaced only slightly from surface 7, could have only a small moment arm to act either in shear or as an overturning force tending to pivot the body of ring 24 about the corner at the junction of wall 14 and surface 7. Hence, for practical purposes, the force generated by the hydraulic pressure acting upwardly on ring 17 is accepted by split ring 24 essentially in compression. Similarly, axial loads applied downwardly to piston body 6 when the annular space below seal ring 17 is filled with hydraulic fluid are applied to ring 17 via split ring 24, with ring 24 accepting the load essentially in compression.

When pressure fluid is admitted to the annular space between seal rings 17 and 20 to drive piston 4 upwardly, the resulting pressure acts downwardly on ring 40 and that ring is simply urged against shoulder 42. However, when pressure fluid is admitted to the annular space between ring 40 and piston flange 10 in order to actuate the piston downwardly relative to body 3, the resulting pressure acts upwardly on ring 40, forcing engagement of shoulder 43 with the lower active face of split ring 44 so that the load is accepted by ring 44 in compression as explained with reference to the function of ring 24.

What is claimed is:

1. In a device of the type described, the combination of a first member having
- a cylindrical surface interrupted by a transverse annular retaining groove,
- the retaining groove having a bottom wall, a first side wall which is frustoconical and slants away from the bottom wall, and a second side wall;

a second member having
- a cylindrical surface,
- a transverse annular surface, and
- an annular frustoconical shoulder joining said transverse annular surface and said cylindrical surface of the second member;

said first and second members being telescopically related with one of said cylindrical surfaces embracing the other,
- the frustoconical shoulder of the second member being parallel to and spaced from said frustoconical first side wall of the groove of the first member;

a split resilient fastener ring engaged in the groove of the first member in substantially relaxed and undistorted condition and having
- a right cylindrical surface extending parallel to and at least immediately adjacent to the bottom wall of the groove,
- a first frustoconical active surface facing the frustoconical first side wall of the groove and extending parallel thereto, and a second frustoconical active surface opposite and parallel to the first active surface and extending beyond said cylindrical surfaces of the first and second members and beyond the intersection of the frustoconical shoulder and the transverse annular surface of the second member, the second active surface of the fastener ring being disposed for flush engagement by the frustoconical shoulder of the second member; and a stop carried by the first member and coacting with the second member to prevent relative axial movement between the first and second members in a direction which would separate the frustoconical shoulder and the fastener ring;

the first active surface of the ring engaging the first side wall of the groove over a radial distance which is at least as great as the radial distance over which the shoulder of the second member can engage the second active surface of the ring;

the shape and dimensions of the second member and the location of the stop carried by the first member being such that, when the stop and second member are engaged, the fastener ring can be inserted into the groove through the space between the frustoconical first side wall of the groove and the frustoconical shoulder of the second member.

2. The combination according to claim 1, wherein the radial distance over which said first active surface of the ring engages said first side wall of the groove is greater than the radial distance over which the shoulder of said second member can engage said second active surface of the ring.

3. The combination according to claim 1, wherein said right cylindrical surface of the ring engages the bottom wall of the groove.

4. The combination according to claim 1, wherein said second side wall of the groove presents a flat transverse annular surface; and the ring includes a flat transverse annular surface joining said right cylindrical surface and the second active surface of the ring, said flat transverse annular surface of the ring being adjacent said flat transverse annular surface of the second side wall of the groove.

5. The combination according to claim 1, wherein the portion of the ring projecting beyond said cylindrical surfaces of said first and second members presents a circular edge facing away from the groove, the combination further comprising stop means carried by the second member and disposed adjacent said circular edge to prevent escape of the fastener ring from the groove.

6. The combination according to claim 1, wherein said first side wall of the groove, said first and second active surfaces of the ring, and said shoulder of said second member all taper at approximately 45°.

7. A split ring fastener in the form of an integral metal piece having sufficient resiliency to be distorted for installation in a retaining groove, the ring having in its relaxed and undistorted condition two mutually parallel active faces which are frustoconical and taper toward the central axis of the ring;

a right cylindrical inner surface parallel to the central axis of the ring and intersecting one of the two active faces;

a right cylindrical outer surface concentric with the inner surface and intersecting the other of the two active surfaces; and two mutually parallel flat transverse annular end faces lying in planes at right angles to the central axis of the ring, one of the end faces intersecting both the inner surface and one of the active faces, the other of the end faces intersecting both the outer surface and the other of the active faces.

8. A split ring fastener according to claim 7, wherein said active surfaces are significantly wider than said end faces.

9. A split ring fastener according to claim 7, wherein said active faces taper at approximately 45°.

10. A split ring fastener according to claim 7, wherein the thickness of the ring along lines normal to the frustoconical active faces is at least 50% of the radial distance between the inner and outer surfaces.

11. The combination defined in claim 1, wherein the stop carried by the first member is a first transverse annular frustoconical shoulder, the second member having a second transverse annular shoulder disposed to engage the stop shoulder; and said transverse annular surface of the second member constituting an end face of that member.

* * * * *